United States Patent [19]

Kotulla et al.

[11] 4,273,476

[45] Jun. 16, 1981

[54] REINFORCEMENT OF ARMORED EARTH WORK CONSTRUCTIONS

[75] Inventors: Bernhard Kotulla, Cologne; Hans Haas, Hoffnungsthal; Martin Weiser, Cologne; Rolf Förster, Cologne; Lothar Preis, Cologne; Rudolf Schmidt, Burscheid, all of Fed. Rep. of Germany

[73] Assignee: Bayer Aktiengesellschaft, Leverkusen

[21] Appl. No.: 960,817

[22] Filed: Nov. 15, 1978

[30] Foreign Application Priority Data

Nov. 29, 1977 [DE] Fed. Rep. of Germany ..... 2753243

[51] Int. Cl.[3] ..... E02D 5/00

[52] U.S. Cl. ..... 405/258; 405/284

[58] Field of Search ..... 405/258, 262, 263, 272, 405/273, 284, 287; 427/389.8, 393.4, 136; 428/290, 268

[56] References Cited

U.S. PATENT DOCUMENTS

| | | | |
|---|---|---|---|
| 3,421,326 | 1/1969 | Vidal | 405/284 |
| 3,467,490 | 9/1969 | Sommer | 427/389.8 X |
| 3,570,253 | 3/1971 | Vidal | 405/284 |
| 3,670,506 | 6/1972 | Gaudard | 405/258 |
| 3,925,994 | 12/1975 | Broms et al. | 405/258 |
| 3,939,662 | 2/1976 | Volz | 427/136 X |
| 3,971,223 | 7/1976 | Barrett | 427/136 X |
| 3,997,697 | 12/1976 | Brochier | 428/290 X |
| 4,167,542 | 9/1979 | Nelson | 428/290 X |

FOREIGN PATENT DOCUMENTS

| | | | |
|---|---|---|---|
| 656062 | 1/1963 | Canada | 405/284 |
| 2053891 | 5/1972 | Fed. Rep. of Germany . | |
| 2055983 | 5/1971 | France . | |
| 2221588 | 10/1974 | France | 405/284 |
| 2234427 | 1/1975 | France . | |
| 1485004 | 9/1977 | United Kingdom | 405/284 |

*Primary Examiner*—Dennis L. Taylor

*Attorney, Agent, or Firm*—Sprung, Felfe, Horn, Lynch & Kramer

[57] ABSTRACT

The outer skin of armored earthwork constructions is attached to bands and the traction is transmitted to the ground by friction. The bands are made of a corrosion resistant, high strength weave or netting of reinforced organic, glass or carbon fibres or fibre mixtures and are preferably impregnated with liquid reaction resins such as epoxide, polyurethane or isocyanate resins. It is advantageous to impregnate the bands and then to harden them only after they have been laid.

18 Claims, 10 Drawing Figures

REINFORCEMENT OF ARMORED EARTH WORK CONSTRUCTIONS

The present invention relates to reinforcements for armoured earth work constructions.

Supporting structures in which metal bands are placed layer-wise at regular intervals into loose, non-cohesive ground to take up traction and transmit it to the ground by fricton are commonly known as "reinforced earth". The socalled ground-filling becomes a weight bearing component of the structure. In order to prevent the ground-filling from receding, it is necessary to provide an outer skin which may comprise metal half shells or prefabricated concrete panels. Descriptions of "reinforced earth" may be found, for example, in "Strasse und Autobahn" 5 (1976) 3/10, "Tiefbau" 8 and 9 (1976) or "Die Bautechnik" 53 (1976) 7, 217/226.

As protection against corrosion, the metal reinforcing bands laid in the ground must be covered with a layer of zinc from 26 to 56 μm in thickness. One particular disadvantage of such bands cut from zinc coated steel sheets is their incomplete cathodic protecton at the edges. Added to this is the fact that for safety reasons the thickness of the band must be increased by the corrosion protective layer by up to 50% of the thickness nominally required for transmitting the load. Equally disadvantageous is the fact that in spite of these measures it is necessary to make additional demands on the pH and electric breakdown resistance of the ground-filling in order not to put the metal reinforcement under critical conditions.

These measures limit the thinness and flatness of the bands and high surface/volume ratio which would be desirable for producing high friction, with the result that the transmission of frictional forces may become insufficient. It has been proposed to improve the frictional contact of bands of steel by means of expensive rolled profiles with transverse ribs of various shapes such as curved ribs, or sloping, or arrow shaped ribs.

Owing to the particularly high risk of corrosion in crevices, the screw connections or bolt connections which have been proposed for connecting the outer skin of the building construction to the reinforcing bands or the reinforcing bands to each other are particularly liable to cause trouble. The use of corrosion protected screws and disks prescribed in the provisional guide lines of the Federal Institute of Road building for use in the "reinforced earth" system is particularly problematic in regions which are exposed to salt from dew or thaw.

It is an object of this invention to overcome the above mentioned disadvantages and weak points of the "reinforced earth" system, particularly the damage due to corrosion, and to improve the frictional connections in the earthwork construction. It also aims to increase the ease of handling and provide simple and secure connection of the reinforcing elements with the outer skin.

According to the present invention there are provided reinforcements for armoured earthwork constructions, comprising high strength, corrosion resistant bands in the form of netting or weaves for positive connection to the outer skin of a building construction.

According to the invention, it is proposed to use corrosion resistant, high strength bands in the form of weaves or netting as reinforcing elements. Using weaves or netting of stretched organic fibres reinforced mainly in the warp, it is possible to obtain the strengths of the building steels normally used, and the weaves or netting are in themselves largely corrosion resistant simply due to suitable choice of the main materials from which they are produced. It is therefore possible, to use sufficiently wide, thin bands which by virtue of their high ratio of perimeter to cross-sectional area and their large surface area, are capable of transmitting high frictional forces into the ground without any special aids to increase their friction such as, for example, ribs. Another advantageous feature of the reinforcing bands according to the invention lies in the structure of the weave or netting, which has the effect of increasing the friction so that, since the reinforcing bands have a high tensile strength, it is possible to produce substantially higher frictional forces than in smooth or broad bands. For this purpose, the bands preferably have a wide mesh. The friction can also be influenced by the nature of the weave (e.g. Atlas, twill or linen).

Since the bands of the invention are quite limp, they can be adapted to the irregularities of the ground filling when laid on the building site and there is also little risk of injury when the various layers of the ground are being filled up. The bands may be rolled up on reels in great lengths and in contrast to the usual technique the armouring elements are cut up into the individual lengths only when they have been brought to the building site, so that the cost of transport and of laying the bands is very much reduced.

In one particularly preferred embodiment of the reinforcing bands of the invention, the warp reinforced fabric comprises high strength inorganic fibres, for example, glass fibres or carbon fibres, or mixtures of the aforesaid fibres, which are impregnated with liquid reaction resins. These bands preferably have a weight per unit area of from 400 to 800 g/m$^2$. The reaction resins used may be, for example, epoxide, polyurethane or isocyanate resins. Impregnation of the bands may be carried out in impregnating baths between rollers placed directly in front of the device for drawing off the bands from a suitable reel. The quantity of reaction resin used is not critical, the only important condition being that the band should be completely wetted. Generally the breaking load of the bands does not depend on the resin content of the impregnation. It may also be advantageous to lay the weight bearing fabric bands dry and then spray the liquid reaction resin on the bands before the ground is filled up with frictional-earth. It is particularly advantageous to use factory produced prefabricated, preimpregnated bands which only have to be laid out on the building site and then hardened. The hardening time can be adjusted within wide limits, advantageously to leave a margin for laying of between 15 minutes and 2 hours.

In contrast to bands of steel, the band according to the invention when laid adapts itself easily to the irregularities of the ground due to its flexibility. The reaction resin further improves the frictional connection between the band and the earth due to the earth particles adhering to the band, so that the earth surrounding the band performs a powerful supporting function. When the reaction resin has hardened, the band has a rigid form and considerable resistance against slipping. Excellent resistance to corrosion is obtained by using suitable reaction resins. The resistance of the glass and carbon fibres, which is in any case high, is even further increased by the enveloping reaction resins.

When the bands are impregnated with isocyanate resins, the moisture of the ground filling can be used to harden these resins. Generally, perfect hardening is achieved even if the bands are laid in bad weather. Another characteristic, which is an advantage when working on the building site, is that the quantity of resin for impregnation is not critical because the fabric, which is required to function as a stress bearing element, reaches its calculated breaking load regardless of the quantity of resin used for impregnation.

The introduction of force into the bands of weave or netting of the present invention is even simpler and easier to handle than in the usual techniques. It can be achieved, for example, by laying the flexible bands with a hairpin bend in the earthwork construction, the open ends of the band being directed into the earthwork while the loop is supported on a bar which is attached to the outer skin of the building construction and thereby establishes the positive connection between the outer skin and the reinforcing band. Another method of positively connecting the bands to the outer skin of the building construction consists of placing the bands in a loop round the bar on the outer skin and securing the loop by friction with a suitable fastening such as one or more clamps. It is particularly advantageous to attach the impregnated fabric bands by forming one or more overlapping loops over the bar to transmit force to the outer skin of the building construction, these loops then forming the stress bearing connection as the reaction resin hardens. Additional fixing of the individual layers of the bands by fastenings on the bar considerably increases the safety of handling of this connection and enables high tensile stresses to be borne even before the reaction resin has hardened.

With reference to the accompanying drawings.

Figure 1:
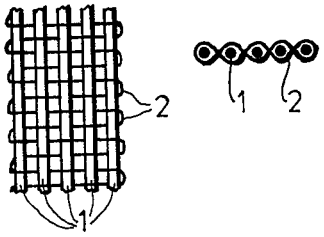
FIGS. 1A and 1B show a warp reinforced fabric band in linen weave in plan view and in cross section, respectively.

FIGS. 1A and 1B show a warp reinforced fabric band in linen weave. It comprises nine glass rovings as warp threads 1 and spun glass threads as weft threads 2 with a load bearing capacity of approximately 12 kN and a width of approximately 60 mm. Glass fabric bands of this type are available commercially, for example as RLS 304016 or RLS 4022 manufactured by A. Weng, Holzhausen, or 94025 manufactured by Interglas Textil GmbH; these have breaking loads of from 6 to 15 kN.

Figure 2:
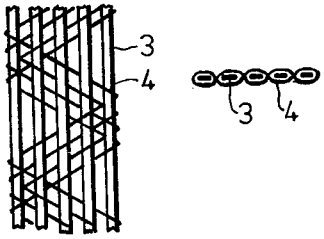
FIGS.2A and 2B show a netting of tapes of stretched organic materials in plan view and in cross section, respectively.

FIGS. 2A and 2B show a laboratory product in the form of a netting of tapes. The warp tape 3 comprises high stretched polyethylene with a thickness of 100 μm and a width of about 5 mm. The weft tape 4 comprises polyethylene and has a width of 0.2 mm and a thickness of 50 μm. The width of the complete netting of nine tapes is 50 mm, its thickness approximately 0.8 mm. The breaking load of this band is approximately 9.7 kN.

Figure 3:
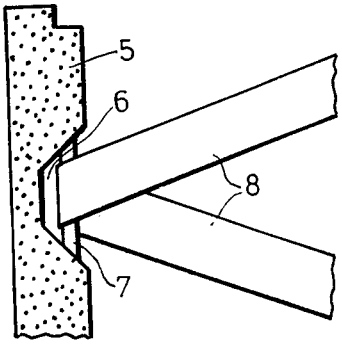
FIG. 3 shows a U-shaped (hairpin shaped) positive connection of a fabric band used as reinforcement to the outer skin of an earthwork construction.

The outer skin of the earth construction is in many cases made of prefabricated concrete elements 5 (FIG. 3). When this has a wall thickness of 20 cm, a polyvinylchloride (PVC) coated steel tube 7 may be placed in a recess 6 at the back of the prefabricated element and embedded in concrete. For a band thickness of 2.5 mm, the tube has a diameter of 30 mm. The warp reinforced fabric band 8 of Perlon yarn (warp/weft ratio 20/1, width 75 mm, thickness 2.5 mm) ("Perlon" is a Trade Mark) is placed as a simple loop round the concrete embedded tube 7 and the open ends of the fabric band 8 extend into the earthwork construction and are secured against slipping of the fabric by melting. The band is laid limp on the ground filling without resin impregnation and then immediately covered with a further layer of ground filling. The band is exposed to a maximum load of approximately 9.3 kN in use. In a fracture test, it failed under a breaking load of 27.5 kN. The co-efficient of friction $\mu$ was found to be 1.7 on compacted earth.

Figure 4:
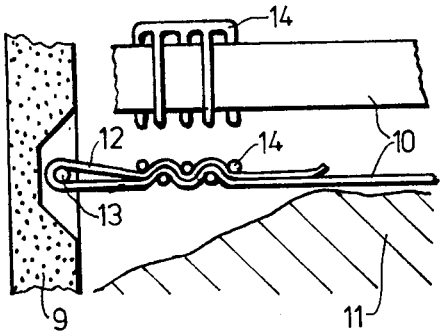
FIGS. 4A and 4B show a positive connection by means of a frictional fastener in side view and in partial front view, respectively.

FIGS. 4A and 4B show another method of anchoring to the outer skin 9. The band 10 is in this case made of stretched organic fibres. It is laid on ground filling 11, placed as a loop 12 round a plastics coated supporting tube 13 and fixed in position by combs 14.

Figure 5:
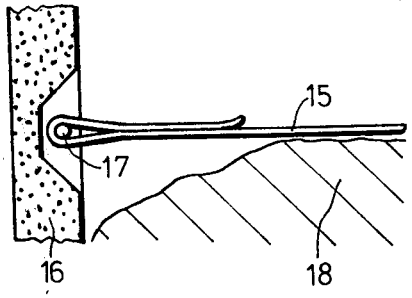
FIG. 5 shows an impregnated fabric band of glass silk.

FIG. 5 shows an impregnated fabric band 15 of glass silk placed round the plastics coated steel tube 17 embedded in concrete in the outer skin 16. As the band 15 is taken off a reel, it is passed through an impregnating bath containing a moisture hardening isocyanate resin with an isocyanate content of ca. 16% and a viscosity of ca. 5,000 mPas, and immediately after impregnation it is laid on ground filling 18 as illustrated and the overlapping end of the band is provisionally secured by means of U-shaped clamps of a copolymer of acrylonitrile-styrene-butadiene (ABS). Under normal conditions, the reaction resin is solid after 50 minutes and the connection to the outer skin of the earth construction has its full stress bearing capacity.

Figure 6:
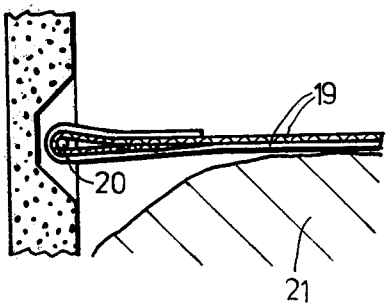
FIG. 6 shows two glass fabric bands laid dry, in double overlap.

FIG. 6 shows two glass fabric bands 19 which are laid dry. Both bands 19 are looped round the PVC coated steel tube 20. The bands 19 are provisionally fixed by clamps. A low viscosity (100 mPas), cold setting epoxide resin containing dibutylamine as hardener is sprayed on the bands until they are completely impregnated. The resin becomes solid after 1½ hours and the bands are then fully load bearing.

Figure 7:
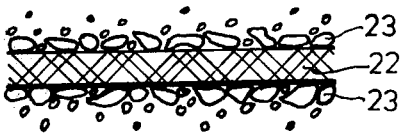
FIG. 7 illustrates schematically how an effect of increasing the friction is obtained.

FIG. 7 illustrates schematically the increased supporting action to impregnated bands. Particles of earth and sand 23 adhere to the impregnated fabric band 22 and thereby increase the friction in the loose earth 24.

What we claim is:

1. A method of reinforcing an armoured earthwork construction comprising the steps of: providing at least one exposed connecting element in the outer skin of at least one building member; impregnating at least one high-strength corrosion-resistant netted or weaved band with liquid reaction resins, which harden after the band has been embedded in the earth; wrapping each band around a connecting element; and embedding the free ends of the band in the earth.

2. The method according to claim 1, wherein the bands are impregnated after wrapping and before being embedded.

3. The method according to claim 1 or claim 2, wherein the reaction resins are epoxide, polyurethane or isocyanate resins.

4. The method according to claim 1, wherein the bands have a warp and a weft and are reinforced principally in the warp direction.

5. The method according to claim 1, wherein the bands comprise synthetic organic fibers.

6. The method according to claim 1, wherein the bands comprise glass fibres, carbon fibres or fibre mixtures thereof.

7. The method according to claim 1, wherein the step of wrapping comprises bending one end portion of each band back on itself to form overlapping portions and clamping the overlapping portions together.

8. The method according to claim 1, wherein the step of wrapping comprises bending one end portion of each band back on itself to form overlapping portions and wherein the overlapping portions are connected upon the hardening of the resin.

9. The method according to claim 2, wherein the step of wrapping comprises bending one end portion of each band back on itself to form overlapping portions and joining the overlapping portions by thereafter impregnating same with the resin and allowing the resin to harden.

10. The method according to claim 9, wherein the reacting resin is a cold setting epoxide resin comprising dibutylamine as a hardener.

11. An armoured earthwork construction comprising: at least one building member having an outer skin with at least one exposed connecting element therein and at least one high strength, corrosion-resistant, netted or weaved band impregnated with liquid reaction resins which harden after the band is embedded in the earth, each wrapped around the connecting element with the free ends thereof embedded in the earth.

12. The construction according to claim 11, wherein the bands have a warp and a weft and are reinforced principally in the warp direction.

13. The construction according to claim 11, wherein the bands comprise synthetic organic fibers.

14. The construction according to claim 11, wherein the bands comprise glass fibres, carbon fibres or fibre mixtures thereof.

15. The construction according to claim 11, wherein the reaction resins are epoxide, polyurethane or isocyanate resins.

16. The construction according to claim 11, wherein the band is wrapped around the connecting element and back on itself to form overlapping portions and further comprising a clamp for connecting the overlapping portions together.

17. The construction according to claim 11, wherein the band is wrapped around the connecting element and back on itself to form overlapping portions and wherein the overlapping portions are connected upon the hardening of the resin.

18. The construction according to claim 17, wherein the reacting resin is a cold setting epoxide resin comprising dibutylamine as a hardener.

* * * * *

UNITED STATES PATENT AND TRADEMARK OFFICE

CERTIFICATE OF CORRECTION

PATENT NO. : 4,273,476

DATED : Jun. 16, 1981

INVENTOR(S) : Bernhard Kotulla et al

It is certified that error appears in the above-identified patent and that said Letters Patent are hereby corrected as shown below:

| | |
|---|---|
| Title Page Assignee | Insert --, Germany and Strabag Bau AG, Cologne, Germany-- after "Leverkusen." |

Signed and Sealed this

*Fifth* Day of *January 1982*

[SEAL]

*Attest:*

GERALD J. MOSSINGHOFF

*Attesting Officer*

*Commissioner of Patents and Trademarks*